US006283826B1

(12) United States Patent
Mizuno

(10) Patent No.: US 6,283,826 B1
(45) Date of Patent: Sep. 4, 2001

(54) EYEGLASS LENS GRINDING APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/322,157

(22) Filed: May 28, 1999

(30) Foreign Application Priority Data

May 29, 1998 (JP) ..... 10-148726

(51) Int. Cl.[7] ..... B24B 49/00
(52) U.S. Cl. ..... 451/6; 451/5
(58) Field of Search ..... 451/6, 5, 42, 43, 451/44

(56) References Cited

U.S. PATENT DOCUMENTS

| | | | | |
|---|---|---|---|---|
| Re. 35,898 | | 9/1998 | Shibata et al. | 451/5 |
| 3,899,851 | * | 8/1975 | Asselin et al. | 51/101 LG |
| 5,138,770 | | 8/1992 | Matsuyama | 33/28 |
| 5,228,242 | | 7/1993 | Matsuyama | 51/165.74 |
| 5,333,412 | | 8/1994 | Matsuyama et al. | 51/165.71 |
| 5,347,762 | | 9/1994 | Shibata et al. | 451/15 |
| 5,803,793 | * | 9/1998 | Mizuno et al. | 451/5 |
| 5,908,348 | * | 6/1999 | Gottschald | 451/5 |
| 6,050,877 | * | 4/2000 | Shibata et al. | 451/5 |

FOREIGN PATENT DOCUMENTS

| | | | |
|---|---|---|---|
| 31 39 873 | 4/1983 | (DE) | B24B/9/14 |
| 2 234 750 | 6/1973 | (FR) | B24B/47/10 |
| 3-20603 | 1/1991 | (JP) | G01B/5/06 |
| 3-66557 | 3/1991 | (JP) | B24B/9/14 |

* cited by examiner

*Primary Examiner*—Derris H. Banks
*Assistant Examiner*—Hadi Shakeri
(74) *Attorney, Agent, or Firm*—Sughrue, Mion, Zinn, Macpeak & Seas, PLLC

(57) ABSTRACT

An eyeglass lens grinding apparatus for grinding a periphery of a lens. A processing device has abrasive wheels, and processes the lens while depressing the lens onto at least one of the abrasive wheels rotatingly driven by an abrasive wheel rotating motor. The lens is fixedly mounted to a first lens chuck shaft through a lens fixing cup. A second lens chuck shaft has a lens pressing holder, and is arranged coaxially with respect to the first lens chuck shaft. A rotating device has a motor and a transmission member that transmits rotational force of the motor to the first lens chuck shaft. A chucking device clamps the lens by relatively moving the second lens chuck shaft with respect to the first lens chuck shaft in a direction of an axis of rotation with a moving mechanism. A first detector detects an angle of rotation of the second lens chuck shaft when the second lens chuck shaft is rotatingly driven by the first lens chuck shaft rotated by the rotating device in a state where the lens is clamped by the first and second lens chuck shafts. A controller controls processing based on a result of detection by the first detector.

15 Claims, 6 Drawing Sheets

EYEGLASS LENS GRINDING APPARATUS

BACKGROUND OF THE INVENTION

The present invention relates to an eyeglass lens grinding apparatus for grinding the periphery of an eyeglass lens.

An apparatus is known, in which a subject lens is clamped by two lens rotating shafts, the lens is rotated by synchronously rotating these two lens rotating shafts by mechanically linking them by means of pulleys, gears, and timing belts, and the lens is ground by moving the lens rotating shafts relative to an abrasive wheel.

In processing, a mounting jig such as a suction cup secured to the front surface side of the lens is fitted to a cup holder provided on one lens rotating shaft, the other lens rotating shaft having a lens holder is moved toward the cup holder to press and clamp the lens. An angle of rotation of the lens during grinding is controlled using a pulse motor which rotates the lens rotating shafts synchronously.

If the force (chuck pressure) with which the lens is pressed by the two lens rotating shafts is weak, the so-called axial offset occurs in which an actual axial angle of the lens is not coincident with an intended angle of rotation of the lens.

Major factors causing this axial offset are a processing error that occurs due to the deformation of a rubber portion of the mounting jig caused by the processing resistance applied by the abrasive wheel during lens grinding, and an error that occurs in the controlled angle of the axis of rotation of the lens due to an insufficient rigidity of a lens rotating mechanism section. The axial offset deteriorates the accuracy of the axial angle of the lens and hinders the accurate reproducibility of the finished shape.

The reduction of the axial offset depends solely on the reduction of the deformation amount of the rubber portion by increasing the chuck pressure to apply a strong pressure to the rubber portion of the mounting jig. However, if an excessively large chuck pressure is applied, the coating film or layer on the lens surface is damaged or broken and, in the case of a glass lens, the lens itself is broken.

SUMMARY OF THE INVENTION

In view of the above-described problems, it is an object of the present invention to provide an eyeglass lens grinding apparatus which makes it possible to effect highly accurate grinding by preventing an axial offset, lens breakage, and coating breakage.

The present invention provides the followings:

(1) An eyeglass lens grinding apparatus for grinding a periphery of a lens, the apparatus comprising:

processing means, having abrasive wheels, for processing the lens while depressing the lens onto at least one of the abrasive wheels or vice versa;

a first lens chuck shaft to which the lens is fixedly mounted through a lens fixing cup;

a second lens chuck shaft having a lens pressing holder, which is arranged coaxially with respect to the first lens chuck shaft;

rotating means for rotating the first lens chuck shaft;

chucking means for clamping the lens by relatively moving the second lens chuck shaft with respect to the first lens chuck shaft in a direction of an axis of rotation;

first detection means for detecting an angle of rotation of the second lens chuck shaft when the second lens chuck shaft is rotatingly driven by the first lens chuck shaft rotated by the rotating means in a state where the lens is clamped by the first and second lens chuck shafts; and control means for controlling processing based on a result of detection by the first detection means;

(2) The eyeglass lens grinding apparatus according to (1), wherein the first and second chuck shafts are rotatable independently of each other.

(3) The eyeglass lens grinding apparatus according to (1), wherein the second lens chuck shaft is not rotated by the rotating means when the lens is not clamped, whereas the second lens chuck shaft is rotated in synchronism with the first lens chuck shaft by the rotating means when the lens is clamped.

(4) The eyeglass lens grinding apparatus according to (1), further comprising:

second detection means for detecting an angle of rotation of the first lens chuck shaft;

calculation means for obtaining an angular deviation between the angle of rotation detected by the first detection means and the angle of rotation detected by the second detection means;

varying means for varying processing pressure based on the angular deviation thus obtained.

(5) The eyeglass lens grinding apparatus according to (4), wherein the rotating means includes a pulse motor, and the second detection means detects the angle of rotation of the first lens chuck shaft driven by the pulse motor.

(6) The eyeglass lens grinding apparatus according to (4), wherein the processing means includes moving means, having a motor, for moving the first and second lens chuck shafts toward the abrasive wheels, and the varying means varies rotational torque of the motor based on the angular deviation thus obtained.

(7) The eyeglass lens grinding apparatus according to (1), wherein the processing means includes moving means for moving the first and second lens chuck shafts toward the abrasive wheels, and the control means controls the moving means based on the result of detection by the first detection means.

(8) The eyeglass lens grinding apparatus according to (7), wherein the control means controls the moving means so as to vary a axis-to-axis distance between a rotational axis of the lens and a rotational axis of the abrasive wheels.

(9) An eyeglass lens grinding apparatus for grinding a periphery of a lens, the apparatus comprising:

a processing device having abrasive wheels, which processes the lens while depressing the lens onto at least one of the abrasive wheels rotatingly driven by an abrasive wheel rotating motor, or vice versa;

a first lens chuck shaft to which the lens is fixedly mounted through a lens fixing cup;

a second lens chuck shaft having a lens pressing holder, which is arranged coaxially with respect to the first lens chuck shaft;

a rotating device having a motor and a transmission member which transmits rotational force of the motor to the first lens chuck shaft;

a chucking device which clamps the lens by relatively moving the second lens chuck shaft with respect to the first lens chuck shaft in a direction of an axis of rotation with a moving mechanism;

a first detector, which detects an angle of rotation of the second lens chuck shaft when the second lens chuck shaft is rotatingly driven by the first lens chuck shaft rotated by the rotating device in a state where the lens is clamped by the first and second lens chuck shafts; and a controller, which controls processing based on a result of detection by the first detector.

(10) The eyeglass lens grinding apparatus according to (9), wherein the moving mechanism includes a motor and a motion-converting member which converts rotational motion of the motor to a linear motion in a direction of an axis about which the first and second lens chuck shafts are rotatable.

(11) The eyeglass lens grinding apparatus according to (9), wherein the first and second lens chuck shafts are rotatable independently of each other.

(12) The eyeglass lens grinding apparatus according to (9), further comprising:

a second detector, which detects an angle of rotation of the first lens chuck shaft;

wherein the controller obtains an angular deviation between the angle of rotation detected by the first detector and the angle of rotation detected by the second detector, and varies processing pressure based on the angular deviation thus obtained.

(13) The eyeglass lens grinding apparatus according to (12), wherein the motor included in the rotating device is a pulse motor, and the second detector detects the angle of rotation of the first lens chuck shaft driven by the pulse motor.

(14) The eyeglass lens grinding apparatus according to (12), wherein the processing device includes a moving device having a lens moving motor, which moves the first and second lens chuck shafts toward the abrasive wheels, and the controller controls rotational torque of the lens moving motor based on the angular deviation thus obtained.

(15) The eyeglass lens grinding apparatus according to (9), wherein the processing device includes a moving device having a lens moving motor, which moves the first and second lens chuck shafts toward the abrasive wheels, and the controller controls the moving device based on the result of detection by the first detector.

(16) The eyeglass lens grinding apparatus according to (15), wherein the controller controls the moving device so as to vary an axis-to-axis distance between a rotational axis of the lens and a rotational axis of the abrasive wheels.

In accordance with the present invention, since processing is controlled while monitoring (detecting) the axial angle of the subject lens which actually rotates, processing becomes possible in which the possibility of axial offset is extremely small.

Further, by monitoring (detecting) the angle of offset between the drive shaft and the subject lens (the driven shaft), the lens can be processed with an optimum load suitable for the lens, and the processing can be performed efficiently in the shortest time while maintaining the processing accuracy.

Moreover, it is possible to lower the chuck pressure, and process the lens while avoiding the lens breakage and coating breakage.

The present disclosure relates to the subject matter contained in Japanese patent application No. Hei. 10-148726 (filed on May 29, 1998), which is expressly incorporated herein by reference in its entirety.

DESCRIPTION OF THE PREFERRED EMBODIMENT

Figure 1:
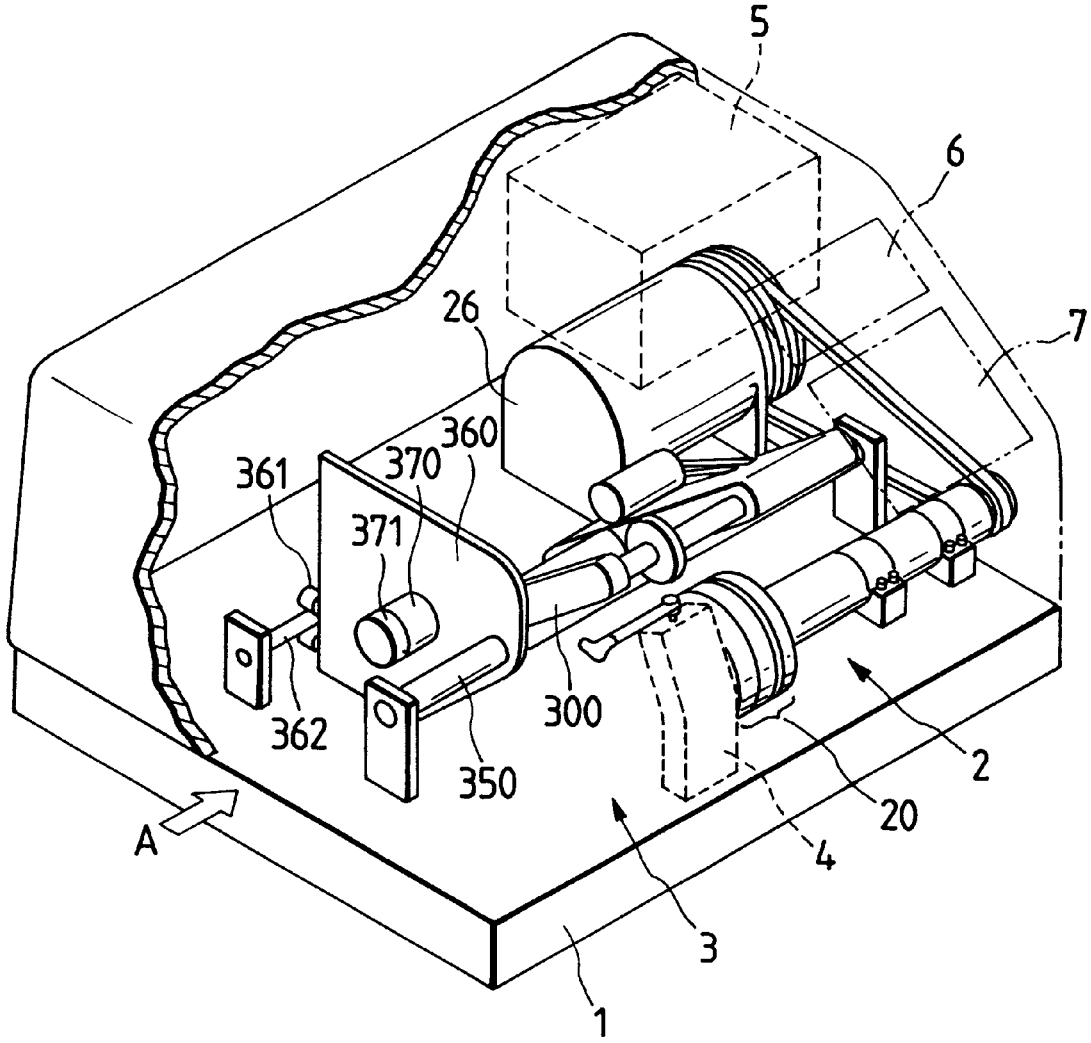
FIG. 1 is a perspective view illustrating an overall configuration of an eyeglass lens grinding apparatus in accordance with the present invention.

Referring now to the accompanying drawings, a description will be given of an embodiment of the present invention. FIG. 1 is a perspective view illustrating an overall configuration of an eyeglass lens grinding apparatus in accordance with the present invention. Arranged on a body base 1 are an abrasive-wheel rotating section 2 for rotating an abrasive wheel group 20, a carriage section 3 for bringing the subject lens clamped by two lens chuck shafts into pressure contact with the abrasive wheel group 20, and a lens-shape measuring section 4. An eyeglass-frame measuring section 5 is incorporated in an upper rear portion of the apparatus, and a display section 6 for displaying results of measurement and processing information as well as an input section 7 having various input switches are arranged on the front surface side of the apparatus casing.

Figure 2:
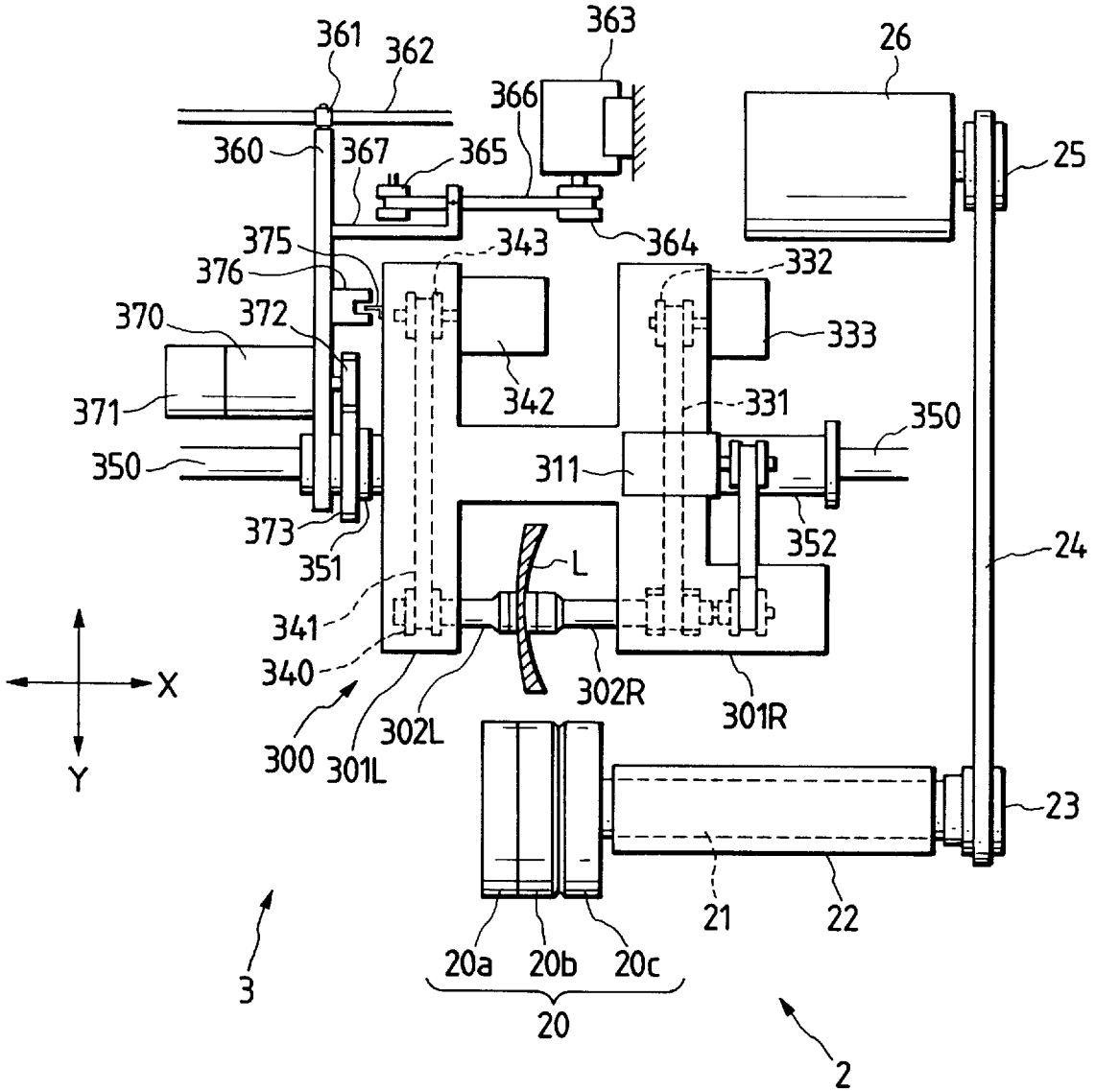
FIG. 2 is a schematic diagram illustrating the construction of an abrasive-wheel rotating section and a carriage section.
Figure 3:
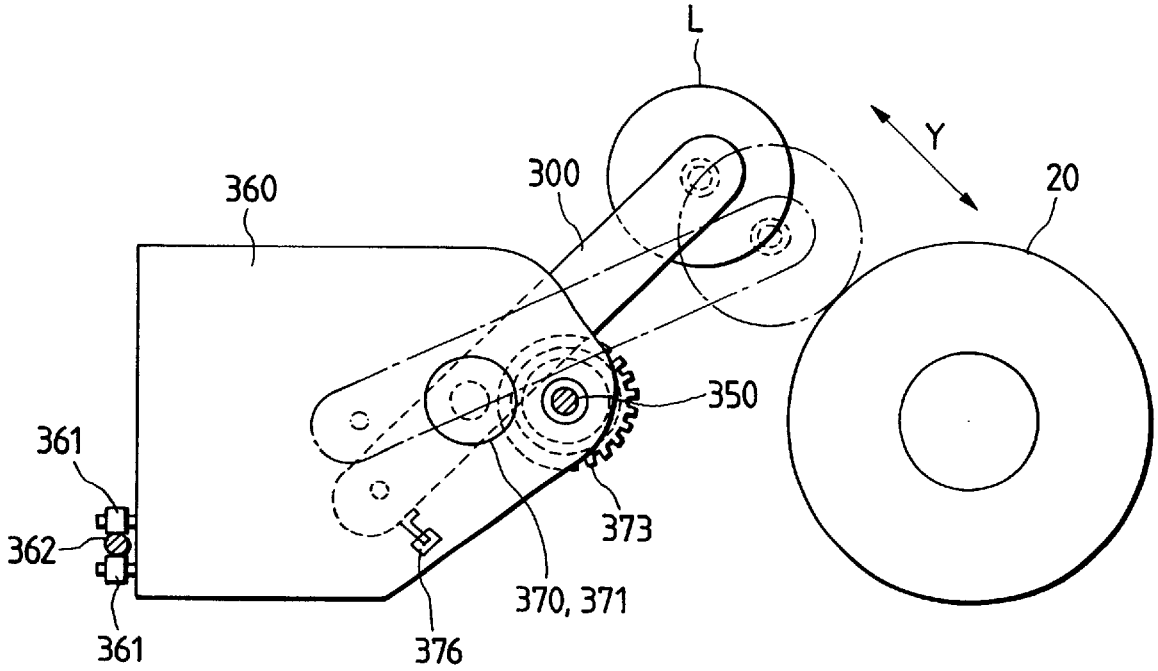
FIG. 3 is a view, taken in the direction of A in FIG. 1, of the carriage section.
Figure 4:
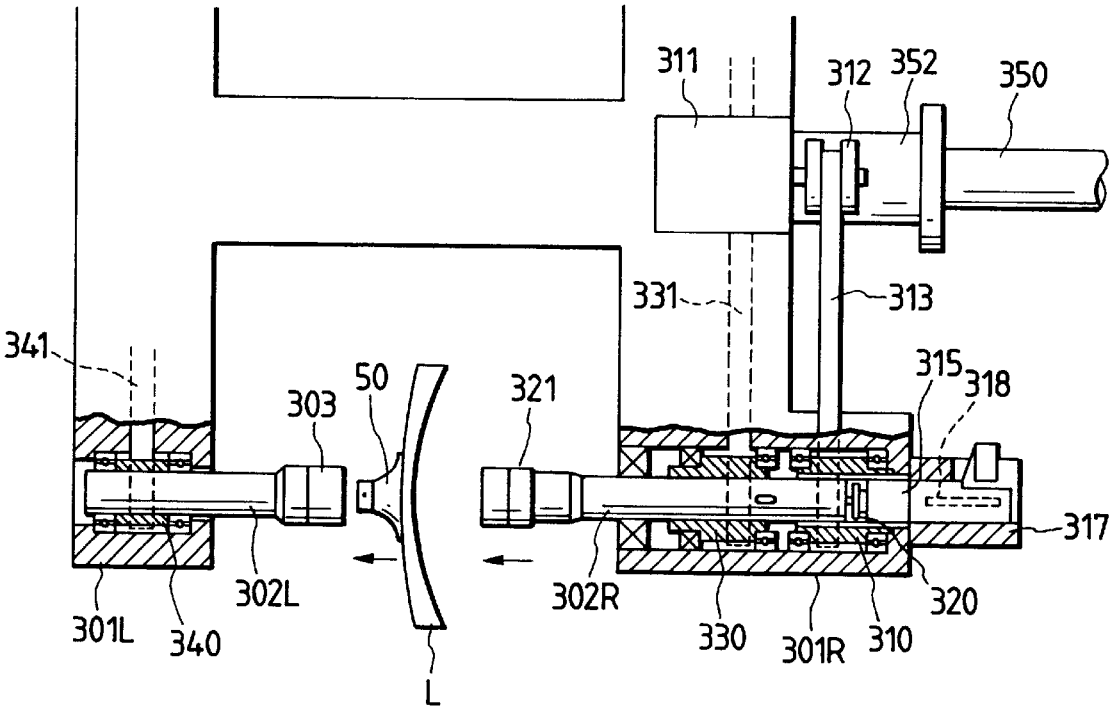
FIG. 4 is a diagram illustrating a lens chuck mechanism.

Next, a description will be given of the construction of the major sections with reference to FIGS. 1 to 4. FIG. 2 is a schematic diagram illustrating the construction of the abrasive-wheel rotating section 2 and the carriage section 3. FIG. 3 is a view, taken in the direction of A in FIG. 1, of the carriage section 3. FIG. 4 is a diagram illustrating a lens chuck mechanism.

Abrasive-wheel Rotating Section

The abrasive wheel group 20 includes a rough abrasive wheel 20*a* for glass lenses, a rough abrasive wheel 20*b* for plastic lenses, and a finishing abrasive wheel 20*c* for beveling and plano-processing, and its abrasive-wheel rotating shaft 21 is rotatably held by a spindle unit 22 secured to the base 1. A pulley 23 is attached to an end of the abrasive-wheel rotating shaft 21, and the pulley 23 is linked to a pulley 25 attached to a rotating shaft of an AC motor 26 for the rotation of the abrasive wheel through a belt 24. Consequently, the abrasive wheel group 20 is rotated as the motor 26 is rotated.

Carriage Section

A substantially H-shaped carriage 300 is arranged to chuck and rotate a subject lens (a lens to be processed) L using two lens chuck shafts 302L and 302R. The carriage 300 is rotatable and slidable with respect to a shaft 350 secured to the base 1 and extending in parallel to the abrasive-wheel rotating shaft 21. Hereafter, a description will be given of a lens chuck mechanism, a lens rotating mechanism, a mechanism for moving the carriage 300 along an X-axis and a mechanism for moving the carriage 300 along a Y-axis, by assuming that the direction in which the carriage 300 is moved in parallel to the abrasive-wheel rotating shaft 21 is the X-axis, and that the direction in which the shaft-to-shaft distance between the lens chuck shafts (302L, 302R) and the abrasive-wheel rotating shaft 21 is changed by the rotation of the carriage 300 is the Y-axis.

(a) Lens Chuck Mechanism

As shown in FIG. 4, the left chuck shaft 302L and the right chuck shaft 302R are held rotatably and coaxially by a left arm 301L and a right arm 301R of the carriage 300, respectively. The operator aligns and fixes a suction cup 50, i.e., a fixing jig, to the front surface of the lens L, and mounts an end portion of the suction cup 50 on a cup receiver 303 provided on an end of the left chuck shaft 302L.

A feed screw 310 is rotatably held inside the right arm 301R and located at the rear of the right chuck shaft 302R. A pulley 312 is attached to the shaft of a chuck motor 311 secured to the center of the carriage 300. The rotation of the pulley 312 is transmitted to the feed screw 310 through a belt 313. A feed nut 315 is disposed inside the feed screw 310 to threadingly engage the feed screw 310. The rotation of the feed nut 315 is regulated by a key way 318 formed in a screw guide 317, so that the rotation of the feed screw 310 causes the feed nut 315 to be moved in the chuck shaft direction (i.e. in the X-axis direction). A cup ring 320 is provided for rotatably connecting the right chuck shaft 302R to a tip of the feed screw 310. Therefore, the right chuck shaft 302R is rotatable, and is moved in the axial direction of the chuck shaft by the feed nut 315. A lens holder (a lens pushing member) 321 is attached to a distal end of the right chuck shaft 302R, and upon receiving a moving force in the leftward direction in FIG. 4 the lens holder 321 presses the lens L to chuck the lens in cooperation with the left chuck shaft 302L. The chuck pressure at this time is detected as an electric current flowing across the motor 311, and the chuck pressure is controlled by supplying a current corresponding to a necessary chuck pressure.

The right chuck shaft 302R is slidably fitted into a pulley 330 rotatably held by bearings. The right chuck shaft 302R is designed to transmit its rotating force to the pulley 330.

(b) Lens Rotating Mechanism

A pulley 340 is attached to the left chuck shaft 302L which is rotatably held inside the left arm 301L of the carriage 300. This pulley 340 is linked to a pulley 343 of a pulse motor 342 which is secured to the rear side of the carriage left arm 301L through a belt 341. When the motor 342 rotates, the left chuck shaft 302L is rotated, and the rotating force of the left chuck shaft 302L is transmitted to the chucked lens L through the cup receiver 303 and the suction cup 50, thereby rotating the lens L. During chucking, since the right chuck shaft 302R is pressed against the lens L through the lens holder 321 as described above, the right chuck shaft 302R is rotated in accordance with and in synchronism with the angle of rotation of the lens L. The rotation of the right chuck shaft 302R is transmitted to an encoder 333, which is attached to the rear of the right arm 301R, through the pulley 330, a belt 331, and a pulley 332, so that the encoder 333 detects the angle of rotation of the right chuck shaft 302R.

(c) Mechanism for Moving the Carriage in the X-Axis Direction

A lower central section of the carriage 300 is held by the bearings 351 and 352 rotatably and slidably with respect to the shaft 350 secured to the base 1, and an intermediate plate 360 is rotatably secured to an end portion of the left-side bearing 351. Two cam followers 361 are attached to a rear end of the intermediate plate 360 at a lower portion thereof, and these cam followers 361 nip a guide shaft 362 fixed to the base 1 in parallel positional relation to the shaft 350. Consequently, the carriage 300 can be moved in the lateral direction (X-axis direction) together with the intermediate plate 360 while being guided by the shaft 350 and the guide shaft 362. This movement is effected by a pulse motor 363 for the X-axis movement, which is secured to the base 1. A belt 366 is suspended between a pulley 364 attached to the rotating shaft of the motor 363 and a pulley 365 rotatably supported by the base 1. A linking member 367 for linking the belt 366 and the intermediate plate 360 is secured to the belt 366. With this arrangement, the motor 363 can move the carriage 300 in the X-axis direction.

(d) Mechanism for Moving the Carriage in the Y-Axis Direction

A servo motor 370 for the Y-axis movement is fixed to the intermediate plat 360 to rotate the carriage 300 about the shaft 350. The motor 370 has an encoder 371 for detecting the angle of rotation. A gear 372 is attached to the rotating shaft of the motor 370, and the gear 372 meshes with a gear 373 fixed to the bearing 351. Accordingly, the carriage 300 can be rotated about the shaft 350 as the motor 370 is rotatingly driven, thereby making it possible to control the Y-axis movement, i.e. the shaft-to-shaft distance between the abrasive-wheel rotating shaft 21 and the lens chuck shafts (the chuck shafts 302L and 302R) (see FIG. 3). Since the servo motor is used for the Y-axis movement, it becomes possible to provide accurate control of the amount of movement and control of rotational torque in comparison with a pulse motor which has the possibility of undergoing an out-of-step state. The encoder 371 detects the amount of movement of the carriage 300 in the Y-axis direction on the basis of the angle of rotation by the motor 370.

A sensor plate 375 is provided in the rear of the left arm 301L of the carriage 300, and as its position is detected by a sensor 376 fixed to the intermediate plate 360, the position of the original point of the rotation of the carriage 300 can be ascertained.

Figure 5:
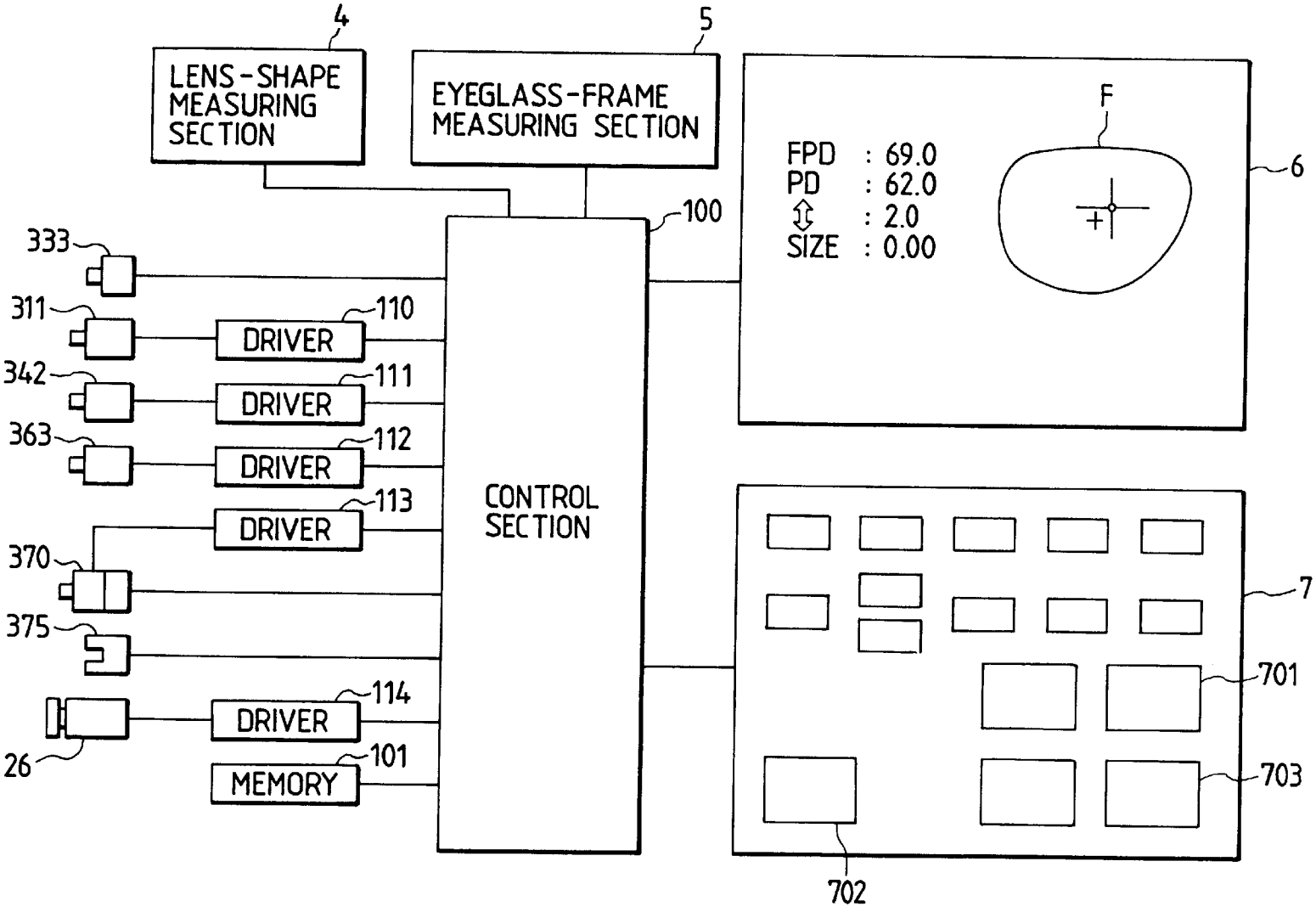
FIG. 5 is a block diagram of essential portions of a control system.

Next, referring to a block diagram of essential portions of a control system shown in FIG. 5, a description will be given of the operation of the apparatus. First, the shape of an eyeglass frame to which a lens is to be fitted is measured by the eyeglass-frame measuring section 5. If a NEXT DATA switch 701 of the input section 7 is pressed, the measured data is stored in a data memory 101, and a target lens shape F is simultaneously displayed on a display of the display section 6. The operator inputs layout data, such as the PD value of the wearer, the FPD value of the eyeglass frame, and the optical center height, by operating the switches of the input section 7. The operator also enters processing conditions including the material of the lens, the material of the frame, and the processing mode, and the like.

Upon completion of the entry of the processing conditions, the operator mounts the lens L with the suction cup 50 attached thereto onto the cup holder 303 on the left chuck shaft 302L side, and then presses a CHUCK switch 702. A control section 100 moves the right chuck shaft 302R by driving the motor 311 through a driver 110 so as to chuck the lens L. Since the chuck pressure at this time is detected as the current flowing across the motor 311, the control section 100 controls the electric power supplied to the motor 311, in order to set the chuck pressure to a predetermined level set so as not to cause coating breakage and lens breakage.

After completion of the preparation of processing, the operator presses a START switch 703 to start processing. The control section 100 sequentially performs the lens shape measurement and the designated processing in accordance with a processing sequence program on the basis of the inputted data, processing conditions, and the like.

The control section 100 obtains processing radius vector information on the basis of the inputted lens data and layout data (refer to U.S. Pat. No. 5,347,762). Subsequently, the control section 100 measures the shape of the lens L using the lens-shape measuring section 4, and determines whether the lens L can be processed into the target lens shape. The rotation of the lens L is controlled by driving the motor 342 connected to a driver 111, the movement of the carriage 300 in the Y-axis direction is controlled by driving the motor 370 connected to a driver 113, and the movement of the carriage 300 in the X-axis direction is controlled by driving the motor 363 connected to a driver 112, to thereby move the lens L to a measuring position. Subsequently, the lens-shape measuring section 4 is operated to obtain shape information based on the processing radius vector information (the construction of the lens-shape measuring section 4 and the measuring operation are basically similar to those described in U.S. Pat. No. 5,347,762).

Upon completion of the lens shape measurement, grinding is performed in accordance with the designated processing mode. First, processing starts with rough grinding. The control section 100 moves the carriage 300 using the motor 363 so that the lens L is located above the rough abrasive wheel 20*a* for glass lenses or the rough abrasive wheel 20*b* for plastic lenses depending on the designated lens material. Subsequently, the carriage 300 is moved toward the abrasive wheel side by the motor 370, and rough grinding is performed while rotating the lens L.

Since the control section 100 has obtained data on the shaft-to-shaft distance between the lens chuck shafts and the abrasive-wheel rotating shaft with respect to the angle of rotation of the lens, the control section 100 controls the movement of the carriage 300 in the Y-axis direction by the rotation of the motor 370 in accordance with the shaft-to-shaft distance data. As the carriage 300 is moved, the lens L chucked by the two lens chuck shafts is brought into pressure contact with the rough abrasive wheel, and is subjected to grinding.

During lens grinding, the lens L is rotated by the rotatively driving force on the left chuck shaft 302L side, and is ground while receiving the grinding resistance from the abrasive wheel. At this time, if the processing resistance is large with respect to the retaining force of the chuck-pressure on the right chuck shaft 302R, the rubber portion of the suction cup 50 is deformed, so that the actual angle of rotation of the lens deviates from the controlled angle of the pulse motor 342 for lens rotation. However, since the right chuck shaft 302R is pressed against the lens L and rotated in accordance with the left chuck shaft 302L, the right chuck shaft 302R rotates in synchronism with the angle of rotation of the lens L. This angle of rotation is detected by the encoder 333, and the control section 100 manages the processing configuration in accordance with the detected angle of rotation. This makes it possible to eliminate the axial offset and perform the high-accuracy processing even if the suction cup 50 is somewhat deformed and/or an excessively large chuck pressure is not applied.

In the event that a large angular deviation (not smaller than a predetermined angular deviation) is found between the rotation of the drive shaft (i.e. the left chuck shaft 302L) driven by the pulse motor 342 and the rotation of the driven shaft (i.e. the right chuck shaft 302R) detected by the encoder 333, a determination is made such that a large load is applied to the lens L, on the basis of which the motor 370 for moving the carriage 300 is controlled to lower the processing pressure and avoid the application of the large load. Alternatively, the large load applied to the lens L may be removed by stopping the rotative driving of the motor 342 or slightly reversing the motor 342. This makes it possible to continuously apply an optimum processing load to the lens without changing the chuck pressure depending on the difference in lens material. Accordingly, processing can be effected efficiently in the shortest time while maintaining the processing accuracy.

In addition, during the lens grinding, the rotational torque of the motor 370 (motor load current) is detected by the driver 113 and fed back to the control section 100. The control section 100 controls the rotational torque of the motor 370 through electric power applied thereto, thereby controlling the processing pressure of the lens L upon the abrasive wheel. This makes it possible to continuously process the lens with an appropriate processing pressure while preventing lens breakage without the need of a complex relief mechanism.

Further, the control section 100 obtains the amount of movement of the carriage 300 (the shaft-to-shaft distance between the lens chuck shafts and the abrasive-wheel rotating shaft) on the basis of the detection signal inputted from the encoder 371 provided on the motor 370, and thereby obtains information on the current configuration of the lens being processed with respect to the angle of rotation of the lens. The control section 100 changes the processing pressure (the set value of the rotational torque of the motor 370) in accordance with the current configuration thus obtained. That is, if the distance from the lens chuck shafts to a point at which the processing is complete is large, the processing is started with a weaker processing pressure caused by the lowering of the carriage 300, and as the distance to the processing complete point is shorter, the processing pressure is gradually increased. In general, if the processing diameter of the lens is large, the resistance against the lens chuck shafts is large. Therefore, by changing the processing pressure depending on the processing diameter of the lens in the above-described manner, the lens can be processed while suppressing the axial offset with respect to the retaining force of the chucking.

Concurrently, the control section 100 can obtain the amount of movement of the carriage 300 on the basis of the detection signal inputted from the encoder 371, to thereby obtain, from this amount of movement and the amount of movement until completion of rough grinding recognized from the processing radius vector information, the information on how degree the unprocessed portion (the unprocessed amount) remains with respect to the angle of rotation of the lens. Since the unprocessed amount can be obtained as quantitative information, it is possible to perform such a processing that a portion of the lens where the unprocessed amount is large is ground in a concentrated manner, whereas a portion of the lens where the unprocessed amount is small is ground with the increased speed of the lens rotation. This makes it possible to shorten the overall processing time.

Figure 6A:
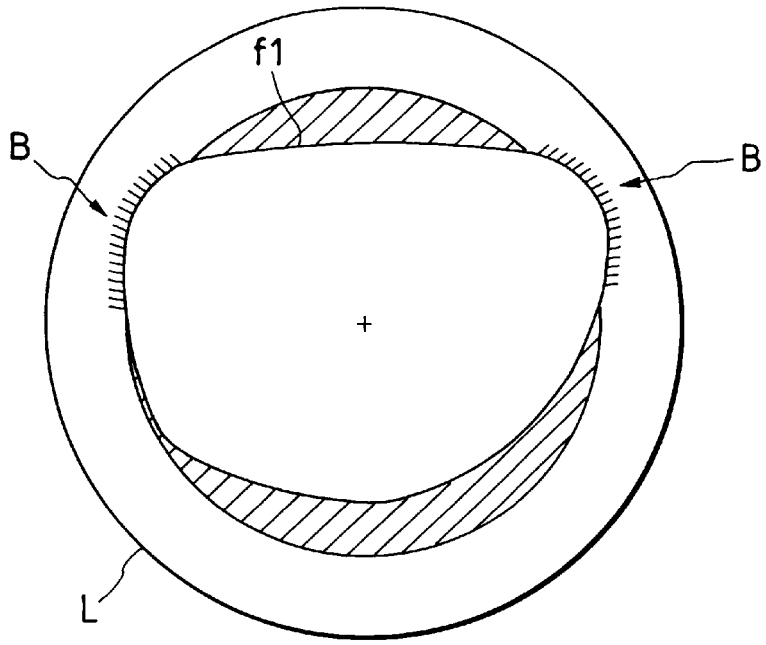
FIG. 6A and FIG. 6B are diagrams for explaining the operation of changing the lens rotation corresponding to an unprocessed amount.
Figure 6B:
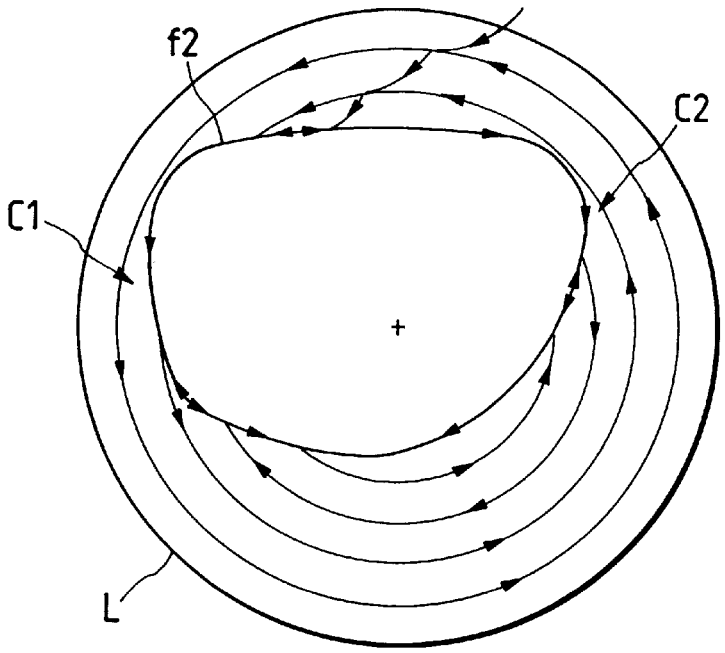

For example, if the lens L is processed into a lens shape f1 while being rotated as shown in FIG. 6A, the rotating speed of the lens is made faster than the initial speed when such a portion (or range) B of the lens where the unprocessed amount is smaller than a predetermined reference (where the unprocessed amount is sufficiently small such that the processing will be complete only by a single rotation of the lens) is ground. As shown in FIG. 6B, when the processing completion is partially obtained on the lens L (or when there appears a portion where the remaining unprocessed amount is sufficiently small such that the processing will be complete only by another single rotation of the lens), the rotating direction of the lens may be changed for that portion, such as a processing-completed portions C1 and C2, during the processing of the lens. In this case as well, the control section 100 obtains information on the processing-completion portions on the basis of the detection signal from the encoder 371, and reversely rotates the lens by reversing the motor 342 through the driver 111 so as not to process such processing-completion portions (so as to eliminate the waste movement of the abrasive wheel group 20 with respect to the lens L). Consequently, it is possible to reduce the amount of rotation of the lens which is not associated with the grinding. Therefore, the grinding efficiency with respect to the rotation of the lens is heightened, thereby making it possible to reduce the overall processing time.

Upon completion of rough grinding, the operation proceeds to finish processing using the finishing abrasive wheel 20*c*. At this time as well, the processing configuration is managed and controlled on the basis of the angle of rotation of the right chuck shaft 302R detected by the encoder 333. During the finish processing as well, the efficient processing with high accuracy can be realized by changing the processing pressure and the rotating direction and rotating speed of the lens in accordance with the configuration of the lens being processed and the unprocessed amount in the same way as during rough grinding.

What is claimed is:

1. An eyeglass lens grinding apparatus for grinding a periphery of a lens, the apparatus comprising:

a processing unit including a processing control unit that can control processing pressure, wherein the processing unit processes a lens while depressing the lens onto at least one of abrasive wheels under control by the processing control unit based on processing data;

a first lens chuck shaft to which a lens fixing cup is mounted, the lens fixing cup being mounted to the lens;

a second lens chuck shaft having a lens pressing holder, which is arranged coaxially with respect to the first lens chuck shaft;

a rotating unit which rotates the first lens chuck shaft;

a moving unit which relatively moves the second lens chuck shaft with respect to the first lens chuck shaft in a direction of an axis of rotation to clamp the lens;

a detection unit which detects an angle of rotation of the second lens chuck shaft with respect to the angle of rotation of the first lens chuck shaft; and an instruction unit which instructs the processing control unit to lower the processing pressure, based on a result of detection by the detection unit, if an angular deviation exceeding a predetermined level is caused.

2. An eyeglass lens grinding apparatus for grinding a periphery of a lens, the apparatus comprising:

a processing unit including a processing control unit, wherein the processing unit processes a lens while depressing the lens onto at least one of abrasive wheels under control by the processing control unit based on processing data;

a first lens chuck shaft to which a lens fixing cup is mounted, the lens fixing cup being mounted to the lens;

a rotating unit which rotates the first lens chuck shaft;

a second lens chuck shaft having a lens pressing holder, which is arranged coaxially with respect to the first lens chuck shaft, wherein the second lens chuck shaft is not rotated by rotational force caused by the rotating unit when the lens is not clamped, and the second lens chuck shaft is rotated in synchronism with the first lens chuck shaft by the rotational force caused by the rotating unit when the lens is clamped; and a moving unit which relatively moves the second lens chuck shaft with respect to the first lens chuck shaft in a direction of an axis of rotation to clamp the lens.

3. The eyeglass lens grinding apparatus according to claim 1, wherein the second lens chuck shaft is not rotated by rotational force caused by the rotating unit if the lens is not clamped, and the second lens chuck shaft is rotated in synchronism with the first lens chuck shaft by the rotational force caused by the rotating unit if the lens is clamped.

4. The eyeglass lens grinding apparatus according to claim 1, wherein the rotating unit includes a pulse motor, and the detection unit includes a detector which detects the angle of rotation of the second lens chuck shaft, and a detector which detects the angle of rotation of the first lens chuck shaft based on an angular control of the pulse motor.

5. The eyeglass lens grinding apparatus according to claim 1, wherein the processing unit includes a second moving unit having a motor, which relatively moves the first and second lens chuck shafts with respect to the abrasive wheels, and the instruction unit instructs the processing control unit to vary rotational torque of the motor.

6. The eyeglass lens grinding apparatus according to claim 1, wherein the processing unit includes a second moving unit which relatively moves the first and second lens chuck shafts with respect to the abrasive wheels, and the instruction unit instructs the processing control unit to lower the processing pressure given by the second moving unit.

7. The eyeglass lens grinding apparatus according to claim 1, wherein the instruction unit instructs the processing control unit to stop or reverse the rotation caused by the rotating unit.

8. An eyeglass lens grinding apparatus for grinding a periphery of a lens, the apparatus comprising:

a processing unit having abrasive wheels, which processes the lens while depressing the lens onto at least one of the abrasive wheels rotatingly driven by an abrasive wheel rotating motor;

a first lens chuck shaft to which a lens fixing cup is mounted, the lens fixing cup being mounted to the lens;

a second lens chuck shaft having a lens pressing holder, which is arranged coaxially with respect to the first lens shuck shaft;

a rotating unit having a motor and a transmission member which transmits rotational force of the motor to the first lens chuck shaft;

a moving unit which relatively moves the second lens chuck shaft with respect to the first lens chuck shaft in a direction of an axis of rotation to clamp the lens;

a detection unit which detects an angle of rotation of the second lens chuck shaft with respect to an angle of rotation of the first lens chuck shaft; and a controller which controls the processing unit, based on a result of detection by the detection unit, to lower processing pressure if a rotational deviation exceeding a predetermined level is caused.

9. The eyeglass lens grinding apparatus according to claim 8, wherein the moving unit includes a motor and a motion-converting member which converts rotational motion of the motor to a linear motion in a direction of an axis about which the first and second lens chuck shafts are rotatable.

10. The eyeglass lens grinding apparatus according to claim 8, wherein the second lens chuck shaft is not rotated by rotational force caused by the rotating unit if the lens is not clamped, and the second lens chuck shaft is rotated in synchronism with the first lens chuck shaft by the rotational force caused by the rotating unit if the lens is clamped.

11. The eyeglass lens grinding apparatus according to claim 8, wherein the motor included in the rotating unit includes a pulse motor, and the detection unit includes a detector which detects the angle of rotation of the second lens chuck shaft, and a detector which detects the angle of rotation of the first lens chuck shaft based on angular control of the pulse motor.

12. The eyeglass lens grinding apparatus according to claim 8, wherein the processing unit includes a second moving unit having a motor, which relatively moves the first and second lens chuck shafts with respect to the abrasive wheels, and the controller controls the processing unit to vary rotational torque of the motor of the second moving unit.

13. The eyeglass lens grinding apparatus according to claim 8, wherein the processing unit includes a second moving unit which relatively moves the first and second lens chuck shafts with respect to the abrasive wheels, and the controller controls the processing unit to lower processing pressure given by the second moving unit.

14. The eyeglass lens grinding apparatus according to claim 1, wherein the processing control unit manages processing configuration of the lens based on the detected angle of rotation of the second lens chuck shaft.

15. The eyeglass lens grinding apparatus according to claim 8, wherein the controller manages processing configuration of the lens based on the detected angle of rotation of the second lens chuck shaft.

* * * * *